United States Patent [19]

Swift

[11] 4,118,098

[45] Oct. 3, 1978

[54] CONNECTOR FOR REED SWITCHES

[75] Inventor: James L. Swift, Staten Island, N.Y.

[73] Assignee: American District Telegraph Corporation, Jersey City, N.J.

[21] Appl. No.: 759,254

[22] Filed: Jan. 14, 1977

[51] Int. Cl.[2] ..... H01R 9/10

[52] U.S. Cl. ..... 339/263 R

[58] Field of Search ..... 339/147, 263 R; 335/151-154

[56] References Cited

U.S. PATENT DOCUMENTS

| | | | |
|---|---|---|---|
| 2,059,467 | 11/1936 | Lowenstein | 339/263 R |
| 2,116,388 | 5/1938 | Eichblatt | 339/263 R |
| 2,280,893 | 4/1942 | Cox | 335/151 |

FOREIGN PATENT DOCUMENTS

| | | | |
|---|---|---|---|
| 492,975 | 9/1938 | United Kingdom | 339/263 R |

*Primary Examiner*—Joseph H. McGlynn

*Attorney, Agent, or Firm*—Thomas L. Giannetti; Charles B. Smith

[57] ABSTRACT

An improved electrical connector for reed switches and other similarly configured switches, in which the electrical leads projecting from the ends of the switch are clamped to a connector base by screw-driven terminal clamping plates, thereby establishing electrical contact with the switch. Washers placed between the leads and the connector base improve the reliability of the contact by reducing the amount of deformation of the base material caused by the stress of clamping.

1 Claim, 2 Drawing Figures

CONNECTOR FOR REED SWITCHES

BACKGROUND OF THE INVENTION

1. Field of the Invention

This invention is directed to the field of electrodynamically actuated switches of the vacuum or hermetically sealed type (e.g., reed switches).

Magnetically operated reed switches are used in contact applications requiring switching devices capable of repetitive operation over a long period of time without replacement or maintenance. One such application is in the contacts of a burglar alarm system which is mounted on a door frame. There the switch is magnetically actuated each time the door is opened. Other typical applications include limit switches for detecting movement in the elements of machines, and in the keyboard mechanisms of automatic business machines.

Reed switches are generally constructed of a pair of aligned contact reeds of a magnetic material, disposed within a sealed glass envelope or similar container. A portion of each of the reeds protrudes from the sealed container as a lead. Preferably the envelope is elongated, with the leads projecting from its ends. These leads allow the switch to be connected in myriad electrical applications.

In one form, the reeds are aligned in the envelope or container so that they are normally not engaged with each other, i.e., the open position. The switch is closed under the impetus of a magnetic force field which encompasses the reeds and causes them to be attracted toward one another. Reed switches of this kind will last almost indefinitely in a switching mechanism, and are good for literally millions of operations without failure or maintenance.

It can be seen that this invention can additionally be applied to connecting other forms of reed switches, e.g., those wherein the reeds are aligned so that the switch is normally in the closed position, as well as in so-called transfer applications, wherein three contact reeds are disposed within the glass envelope, the first of said three contact reeds being transferred by a changing magnetic field from electrical contact with one of the remaining two contact reeds to the second of the remaining reeds, thereby briefly causing an open circuit during the transfer which can be detected. Moreover, the invention is also applicable to the connection of other glass enclosed switches, e.g., mercury switches.

2. Description of the Prior Art

The connection of reed switches and other similarly configured switches requires that electrical contact be established between the conductor leads projecting from the switch envelope and the external circuit to which the switch is connected. However, the switches themselves, because they are small and fragile, are usually first connected to a connector assembly which provides support and protection, as well as a means for making electrical connection to the external circuit. Then, the completed connector-switch combination is inserted where needed in the external circuit.

Sometimes, the switches must be modified for mounting on a particular connector assembly by bending the leads which project from the ends of the glass envelope. This is necessary, for example, when the leads are to be connected to the assembly by wrapping them around internal terminal posts. However, because these leads form part of the magnetic environment of the switch, deformation of the leads affects the operation of the circuit by changing the switch characteristics. For example, bending the leads raises slightly the magnetic field strength required to actuate the switch (the pull-in ampere-turn value). Another modification often necessary to facilitate external circuit connection is shaping the reed switch lead ends into specific formations. This particularized shaping, such as by lead forming or bending, must be done with great care to avoid damaging the delicate seals between the glass envelope and the metal leads. Any weakening of these vacuum seals substantially increases the risk of switch failure under operating electrical load conditions and decreases useful life.

In some instances, neither lead bending nor forming is sufficient to produce the required lead configuration. In this case, additional conductive material, sometimes termed a pigtail, must be welded or soldered onto the leads to permit circuit connection. Often, the leads themselves are welded or soldered directly to terminals in a switch assembly, as shown, for example, in U.S. Pat. Nos. 3,293,578, 3,321,723, and 3,302,143, all incorporated herein by reference. During such welding or soldering, the leads, displaying heat conductive properties different from the glass envelope, expand and contract much more quickly than the envelope. These unbalanced heat effects create internal stress forces which lead to loose or cracked glass-to-metal seals, thus degrading switch performance as noted previously. Moreover, welding and soldering, laborious and expensive manufacturing steps, increase substantially the cost of the switch.

The prior art, particularly U.S. Pat. No. 3,292,123, incorporated herein by reference, displays the use of a screw engaging a nut to establish the electrical connection of a reed switch. This connection results from clamping each lead of the switch, on tightening the screw, between the bolt and a block through which the screw acts. However, in this arrangement, permanent mechanical deformation of the block material contacting the lead usually occurs due to the stress applied by the screw and nut combination. In a plastic block, for example, this phenomenon of permanent deformation resulting from prolonged application of a stress below the elastic limit of the plastic is known as creep or cold flow. Deformation or cold flow results, in time, in a reduction in the contact force between the lead and the metal bolt. The weakened contact thereby creates a risk of loss of electrical contact within the switch. Thus, in applications where long-term reliability is critically important, such as burglar alarms, the adverse effects of deformation or cold flow on switch contact maintenance must be eliminated. Significantly, this deformation is more pronounced in reed switches having leads of circular cross section and small diameter (e.g., a few mils), than in those having flat leads such as described in United States Patent No. 3,292,123.

Prior connectors for reed switches also use sockets or slots for receiving the conductor leads of the switch. Such an arrangement is shown for example in U.S. Pat. No. 3,271,708, incorporated herein by reference. There the connection to the reed switch leads is made through slotted spring clips. Yet, spring clips have proven to be unreliable in continuous use applications, making them particularly unsuited for burglar alarms and other systems where reliability is a paramount factor.

In summary, prior methods for connecting reed switches to external electrical circuits usually involve the steps of bending, forming, welding or soldering of the leads. The connective methods in addition to being laborious and expensive often result in damage to the switch or changes in its operating characteristics. Moreover, those prior methods which avoid these unfavored connective steps produce electrical circuits with the switch which are not suited to applications where high reliability is an important design factor.

SUMMARY OF THE INVENTION

It is thus an object of this invention to provide a connector for reed switches and other types of electrodynamically actuated switches, e.g., those vacuum or hermetically sealed in glass envelopes, which permits the quick, efficient and reliable external circuit connection of these switches.

It is another object to provide a switch connector assembly which substantially reduces any risk of damage to the fragile seals between the glass envelope and the switch leads protruding from this envelope.

It is a further object of this invention to provide a switch connector which does not require soldering or welding to establish an electrical connection.

It is still a further object to provide a switch connector which substantially eliminates any modification of the operating characteristics of the switch during external connection of the leads.

The present invention comprises an improved electrical connector for switches, particularly reed switches. This connector comprises a non-conducting connector base; a connective means for contacting each electrical lead extending from the switch envelope of a switch and substantially preventing the deformation of the base local to those leads; and clamping means for engaging the base and the connective means to mount the switch on the base and to maintain the connective means contact of each electrical lead.

More particularly, the connective means must be of sufficient hardness to substantially resist deformation local to the leads under clamping pressures. Further, at least a portion of the connecting means in contact with the leads must be conductive to afford a connective site to an external circuit. Preferably these connective means comprise two metal plates or washers. They act jointly under the impetus of the clamping means to effect sandwich-like contact of each switch lead.

The clamping means preferably comprises a threaded member and mate thereof. In this embodiment the member extends through the base and mate such that on thread advance through the mate, a clamping force is adduced to mount the switch on the base and to maintain connective means contact with each electrical lead. More preferably the threaded mate is part of the connective means.

Most preferably, a separate threaded clamping means is provided for each connective means-lead contact. There the threaded members extend through channels in the base and through each connective means, including that mate for the threaded member. In this preferred embodiment a threaded member, e.g., a bolt or screw, extends through a channel in the base and through the two plates of the connecting means, the outer of which is a threaded mate for the member. Advance of the bolt through the connecting means constricts their sandwich about the lead and mounts that portion of the switch to the base.

Although one of these plates or washers may in itself complete the external circuit connection for each lead of the switch, more preferably that separate clamping means for each connecting means-electrical lead contact resides in electrical contact with the conducting portion of the connecting means and serves as a terminal post for connecting the mounted switch assembly to an external circuit. In that preferred embodiment a protective member, whose conductive properties are immaterial but whose hardness is sufficient to substantially resist deformation and cold flow under clamping pressures, preferably is located at the base-clamping means pressure interface. This member in combination with the head of the threaded clamping means provides a connection point for the external circuit. Importantly this protective sandwich avoids that switch unreliability caused by base deformation or cold flow about the lead of the external circuit.

DESCRIPTION OF THE PREFERRED EMBODIMENT

Figure 1:
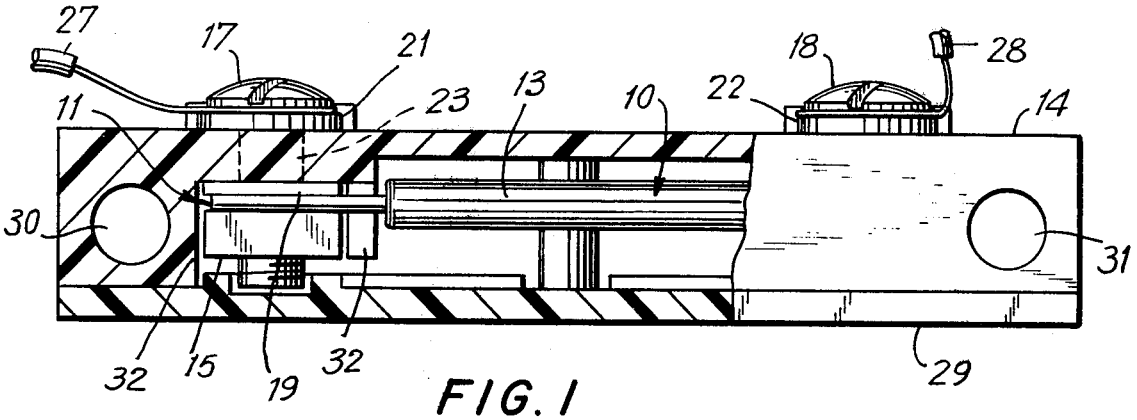
FIG. 1 is a partial sectional view of a reed switch connector assembly which embodies the present invention.
Figure 2:
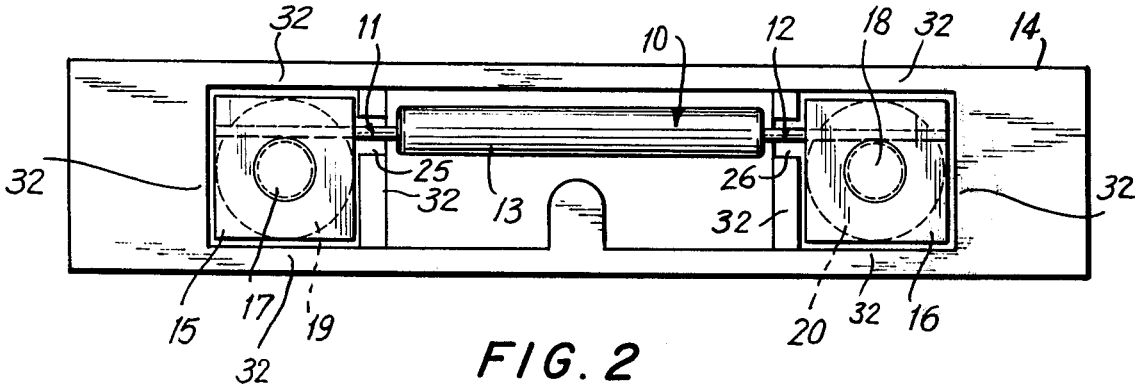
FIG. 2 is a bottom view of the assembly of FIG. 1 with the cover removed.

FIGS. 1-2 illustrate a preferred embodiment of the present invention, as it might be used in a burglar alarm system.

In FIG. 2 reed switch 10 comprises electrical leads 11 and 12 projecting from glass envelope 13. The interior switching reeds within this envelope are not shown. Connector base 14 is constructed as shown from any non-conducting material, e.g., a thermoplastic polyester. To mount switch 10 on connector base 14 and to establish electrical connection with each of switch leads 11 and 12, conductive plates 15 and 16, plates 19 and 20, 21 and 22, and threaded conductive screws 17 and 18, best shown in FIG. 1, are provided.

The clamping action between plates 15–19 and 16–20 on screw advance effects electrical connection of the switch leads through the plates to the screws, and electrical connection between plates 21 and 22 and screws 17 and 18 respectively and external circuit leads 27–28. Moreover, the clamping force between plates 19–21 and 20–22 mounts the switch onto the connector assembly.

In assembly, plates 19 and 20 are first set in base 14 as shown in FIG. 2, the hole in plate 19 being aligned with channel 23 through the base, illustrated by broken lines in FIG. 1. The hole in plate 20 is analogously aligned with channel 24 (not shown). Reed switch 10 is then set in base 14 with its leads 11 and 12 placed respectively in slots 25 and 26 (FIG. 2). Plates 15 and 16 are then set in place as shown in FIG. 2. Screws 17 and 18 are inserted through plates 21 and 22, through channels 23 and 24 in the connector base, and then through plates 19 and 20 respectively. These screws are advanced to engage plates 15 and 16, which are threaded to mate with the respective screws. The screws are tightened until the leads 11 and 12 are firmly clamped between the threaded plates and plates 19 and 20.

Plates 19 and 20 distribute the force applied by the screw clamping means to the connector base. Without these plates the switch leads would be in direct contact with the connector base 14, and on advance of screws 17 and 18 the entire clamping force on the connector base would be applied to that small area of contact between the leads and the base. A prolonged application of such high stress to this small area about the leads could cause permanent deformation of the base material. The chance of this deformation is particularly enhanced when the base material is a plastic. As discussed earlier, such phenomenon of permanent deformation, i.e., creep or cold flow, of a plastic under a steady load is well-known.

Deformation of the material in the area local to the leads 11 and 12 would diminish the contact force between the leads and plates 15 and 16, thereby adversely affecting the electrical connection and reducing the reliability of the switch.

The effects of this localized deformation of base material under stress are even more pronounced with switch leads of circular cross section, especially those of small diameter, e.g., a few mils. A circular cross section as opposed to a wide flat configuration is particularly common for the leads of reed switches, and is illustrated by leads 11 and 12 in FIG. 2. Thus, by distributing the clamping force over a wider area, plates 19 and 20 reduce the localized stress on the base material and thereby substantially reduce any deformation of the base.

Connections between the mounted switch and an external circuit are made by loosening screws 17 and 18, placing circuit leads 27 and 28 between the heads of the screws and plates 21 and 22, as shown in FIG. 1, and retightening the screws. It should be noted that plates 21 and 22 similarly reduce deformation of the connector base at the external lead connectors and thereby increase the reliability of the electrical connection of the reed switch to an external circuit.

It should also be noted that in a preferred embodiment shoulders 32 in the connector base, best shown in FIG. 2, prevent plates 15 and 16 from turning when screws 17 and 18 are advanced, thus facilitating the assembly of the switch connector and the connection of circuit wires to the screws.

Cover 29 can be placed on the connector base as shown in FIG. 1 and cemented in place. The cover protects plates 15–16, 19–20 and screws 17–18 when in place, and additionally acts with shoulders 32 to hold plates 15–16 and 19–20 in alignment with channels 23 and 24 respectively, when screws 17 and 18 are removed. This facilitates reassembly of the connector if screws 17, 18 are removed, either inadvertently or intentionally by someone tampering with the connector.

In a burglar alarm system, the entire switch assembly can be mounted on a door frame using mounting holes 30 and 31, shown in FIG. 1. The switch assembly is connected to an external circuit comprising an alarm system which detects the opening of the switch contacts and provides an alarm signal when this condition occurs. A source of a continuous magnetic field, typically a permanent magnet, is mounted and positioned on the door to be close to the switch assembly when the door is closed. The field provided by this magnet is of sufficient strength to keep the contacts of the switch in a closed position when the door is closed. When the door is opened, the distance between the frame-mounted switch assembly and the door-mounted permanent magnet increases, and the magnetic field strength at the site of the switch assembly drops below the value required to hold the switch closed. The switch opens, and the alarm is activated.

I claim:

1. A switch connector comprising:

a non-conducting connector base;

connective means for contacting each electrical lead of a switch and substantially preventing the deformation of said base local to said electrical lead, said connective means being of sufficient hardness to substantially resist deformation local to said electrical leads and at least a portion of said connective means in contact with each said electrical lead being electrically conductive to provide a terminal for external circuit connection for said lead;

clamping means for engaging said base and connective means to mount said switch on said base and to maintain said connective means in contact with each said electrical lead, said clamping means comprising a pair of threaded members and threaded mates thereof, each of said threaded members extending through channels in said base, through said connective means for each lead and through said mates such that thread advance through said mate provides a clamping force to mount said switch on said base and to maintain said connective means in contact with each said lead;

shoulders formed in said non-conducting connector base and positioned to engage the threaded mates to prevent them from turning during thread advance of the threaded members through the respective mates thereof; and a cover affixable to said connector base for substantially enclosing and protecting the switch, said electrical leads of the switch, said threaded mates and a portion of said threaded members, said cover further acting in combination with said shoulders in the base to hold said threaded mates in alignment with said channels in said base when said threaded members are withdrawn, to facilitate reassembly of the connector.

* * * * *

UNITED STATES PATENT AND TRADEMARK OFFICE

CERTIFICATE OF CORRECTION

PATENT NO. : 4,118,098

DATED : October 3, 1978

INVENTOR(S) : James L. Swift

It is certified that error appears in the above-identified patent and that said Letters Patent are hereby corrected as shown below:

In the Assignee's name (page 1, line [73]), "American District Telegraph Corporation" should read --American District Telegraph Company--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*